US005337786A

United States Patent [19]

Rush et al.

[11] Patent Number: 5,337,786

[45] Date of Patent: Aug. 16, 1994

[54] SLIDE ACTUATION VALVE

[75] Inventors: Robert Rush, Amherst; Paul Fortlage, Medina, both of Ohio

[73] Assignee: MTD Products Inc., Cleveland, Ohio

[21] Appl. No.: 938,569

[22] Filed: Aug. 31, 1992

Related U.S. Application Data

[63] Continuation of Ser. No. 742,228, is a continuation of Ser. No. 549,975, Jul. 9, 1990, abandoned.

[51] Int. Cl.[5] ..... F15B 13/04

[52] U.S. Cl. ..... 137/625.68; 137/625.69

[58] Field of Search ..... 137/625.68, 625.69; 285/211

[56] References Cited

U.S. PATENT DOCUMENTS

| | | | |
|---|---|---|---|
| 2,234,322 | 3/1944 | Sicard | 137/625.23 |
| 2,603,192 | 7/1952 | Kensok | 137/625.68 |
| 2,702,049 | 2/1955 | Seeloff | 137/625.69 |
| 3,234,963 | 2/1966 | Lyon | 137/884 |
| 4,027,697 | 6/1977 | Bonney | 137/625.23 X |
| 4,109,682 | 8/1978 | Gudjonsson | 137/625.23 |
| 4,177,834 | 12/1979 | Bonney | 137/625.23 |
| 4,323,087 | 4/1982 | Brunner | 137/625.68 |
| 4,468,054 | 8/1984 | Orth | 285/211 X |
| 4,548,238 | 10/1985 | Chorkey | 137/625.25 |

FOREIGN PATENT DOCUMENTS

| | | | |
|---|---|---|---|
| 102869 | 10/1962 | Netherlands | 137/625.68 |

*Primary Examiner*—Gerald A. Michalsky
*Attorney, Agent, or Firm*—Lightbody Law Office

[57] ABSTRACT

A slide valve is disclosed utilizing simple straight through drilled holes in the body of the valve in combination with a machined central fluid return passage and extensions off of the cylinder grooves in the valve slide.

25 Claims, 4 Drawing Sheets

SLIDE ACTUATION VALVE

This is a continuation application of Ser. No. 07/742,228 filed Aug. 6, 1991, now abandoned which is a continuation application of Ser. No. 07/549,975 filed Jul. 9, 1990, now abandoned.

This invention relates to a slide actuation valve for hydraulic, pneumatic or other fluidic pressure devices.

BACKGROUND OF THE INVENTION

Historically slide valves for fluidic controls have been very large weighty units designed to provide a controllable non-leaking selective interconnection of the various lines which are fed into the valve. The valves themselves are complex devices needing multiple intricate machining operations and subsequent maintenance in order to insure continual satisfactory performance. These valves are thus of significant size, weight and cost. These combine to limit the number of applications for such valves.

OBJECTS OF THE INVENTION

It is an object of this present invention to reduce the size of fluidic valves.

It is an object of this invention to reduce the complexity of fluidic valves.

It is an object of this invention to reduce the cost of fluidic valves.

It is an object of this invention to increase the service life of fluidic valves.

Other objects and a more complete understanding of the invention may be had by referring to the drawings in which:

DRAWINGS

FIG. 1 is a perspective view of a valve including the invention of the application and including external lines and application lever;

FIG. 2 is a longitudinal plan cross sectional view of the valve of FIG. 1 taken substantially in the plane 2—2 of such figure;

FIG. 2A is a partial view like FIG. 2 of a closed center embodiment modification of the preferred embodiment;

FIG. 2B is a partial view like FIG. 2 of alternate valving arms;

FIG. 3 is a longitudinal cross sectional view of the valve of FIG. 1 taken substantially along plane 3—3 of FIG. 2;

FIG. 4 is a cut away perspective view of the valve of FIG. 1;

FIG. 5 is a plane view of the valve of FIG. 1;

FIG. 6 is a side view of the valve of FIG. 1; and,

FIG. 6A is a partial view like FIG. 6 of a modified link reaction member;

FIG. 7 is an exploded perspective view of a tractor cylinder control incorporating the valve of FIG. 1.

DESCRIPTION OF THE DRAWINGS

This invention relates to a reduced sized hydraulic, pneumatic or other fluidic substance valve. The invention will be described in its preferred embodiment of a hydraulic valve for a remote cylinder on a lawn and garden tractor.

The valve 20 has a valve body 21, a valve slide 22, an actuator lever 23, and interconnecting pipes or hoses 24 (FIGS. 1, 5 and 6).

The valve body 21 for the hydraulic valve mechanically interconnects the other parts of the improved valve together as well as mounts the valve 20 on the associated physical structure (for example the body or frame of a tractor). The preferred valve 20 is a double throw double pole valve interconnecting a source of pressure and a return to an actuation cylinder having bidirectional operation—i.e. first and second cylinder connections on either side of a movable piston. The preferred valve 20 is biased into a no-connection fluid pass through default position. Other types of valves with other modes of operation, connections and biased positions could also be made incorporating the invention of this application.

Figure 1:
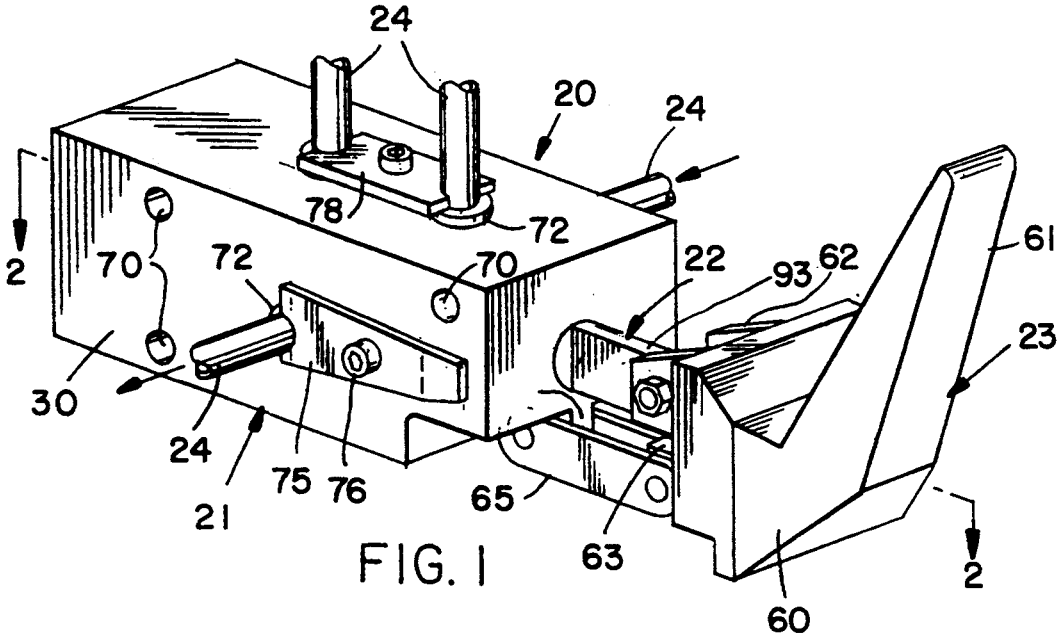
Figure 2:
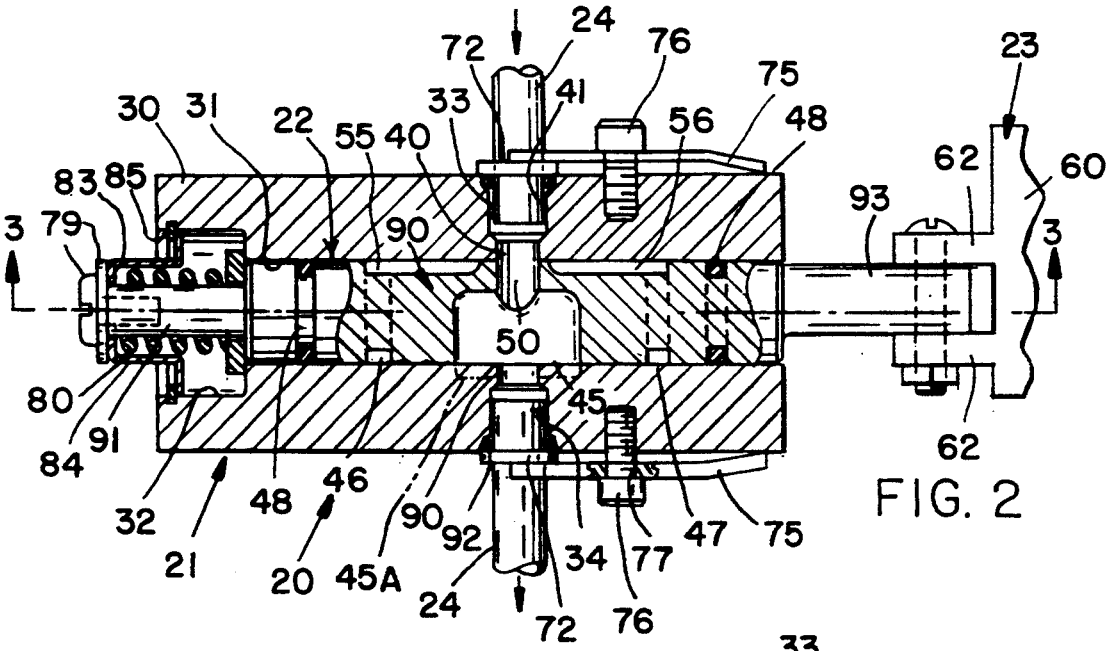
Figure 2B:
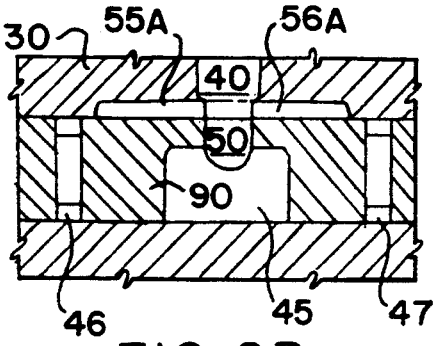
Figure 3:
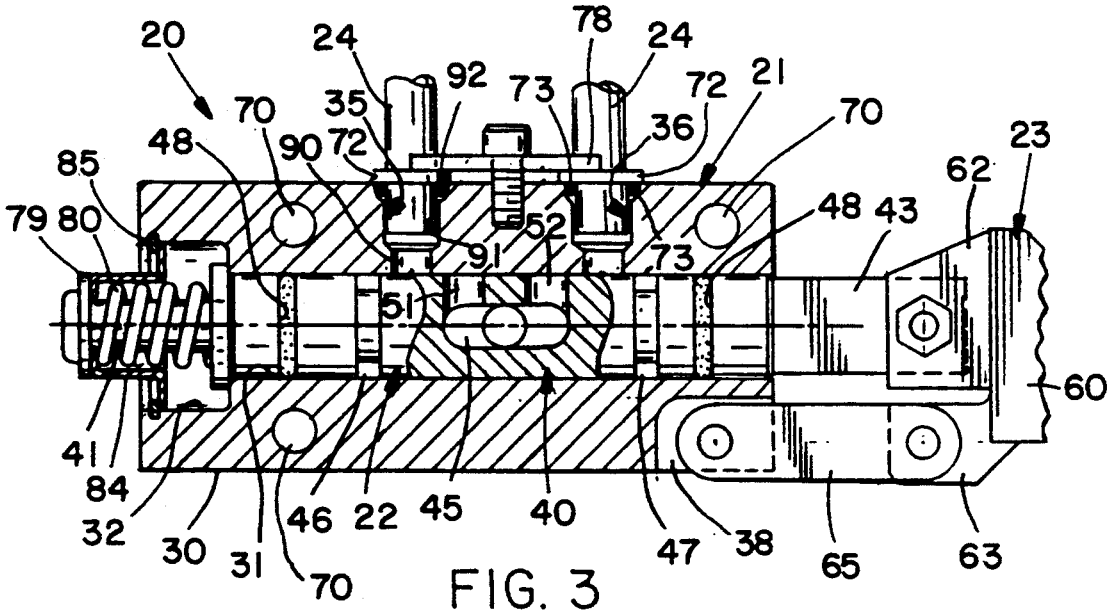
Figure 4:
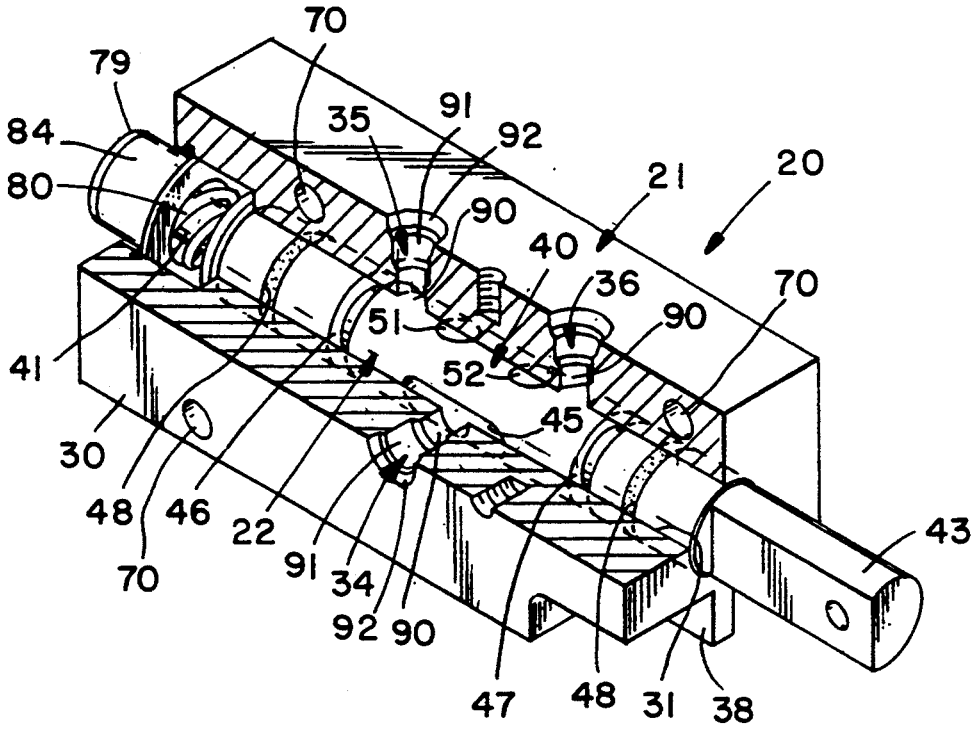

The particular preferred double throw double pole valve 20 shown has a rectangular body section 30 substantially 1.73" square by 3.75" long. An operational hole 31 substantially $\frac{5}{8}$" in diameter extends longitudinally axially through the center of the body section 21. In the preferred embodiment shown the operational hole 31 terminates at one end in an enlarged cylindrical centering opening 32 (FIGS. 2, 3 and 4). This centering opening 32 is for utilization with an internal centering mechanism (later described). If desired this enlarged opening 32 could be omitted (with appropriate modifications to the later described centering mechanism).

The body section 30 can be extruded with the operational hole 31 subsequently honed to precise size. The body section 30 could also be machined with the hole 31 drilled to size. Alternately the body section could be formed of plastic, molded about an inner steel sleeve of tubing (preferably pre-honed to size). In any event it is preferred that the enlarged centering opening 32 be added after formation of the body section 30 (if such is utilized).

Four further operational holes 33–36 extend in the body section 30 from exterior surfaces to intersect the hole 31. It is preferred that these holes 33–36 be drilled or milled into the body section 30. These four holes create four openings: a pressure opening 33, a return opening 34, a first cylinder opening 35, and a second cylinder opening 36. Each of the four openings 33–36 includes an intersection 90 at the hole 31. This intersection 90 is dimensioned in order to pass the volume of fluid required at the operating pressures of the valve respectively in the manner desired by the valve designer. In the particular embodiment shown, the intersection 90 is a simple circular hole substantially 3/16" in diameter. This circular shape is preferred for its ease of manufacture and for its low fluid pressure drop in operation. An intermediate section 91 interconnects this intersection 90 to the external surface of the body section 30 of the valve. The outer diameter of this intermediate section 91 is selected to match the termination desired, in this case the outer diameter of the pipes 24 which will be utilized with the valve to fluidically interconnect such valve 20 to the cylinder. This termination allows the pipe 24 to directly interconnect to the body section 30 of the valve without the necessity of additional plugs or fittings (which may be appropriate or desired in other applications). The intermediate section 91 flairs into a seal groove 92 at the intersection with the external surface of the body section 30 of the valve. This seal groove serves to aid the sealing of the pipe 24 to valve body 21 as later described. Note that each of the four openings 33–36 are of identical configuration down to their circular intersection 90. This is the preferred embodiment for ease of construction. Indeed a shaped drill or mill is preferably utilized to manufacture the entire set of four openings 33–36 disclosed, each in a single operation. If desired the openings for the valve could be individually customized to meet desired operating, construction or individual piping parameters. An example of this would be to taper the intersections 90 for the cylinder openings 35, 36 so as to facilitate the feathering control thereof. Another example would be to tap an opening for a threaded fitting. Other modifications to the number and/or shape of the openings could also be made.

Although the exact positioning of the four openings 33–36 in the preferred embodiment is not critical as long as the openings relate in operation with the other openings as later described, it is preferred that the pressure opening 33 be one flat side of the body section 30 of the valve with the return opening 34 located on the opposing flat side of the body section 30. This provides for a straight through default fluid pass through neutral position. This lowers any pressure loss through and the heat gain for the valve. It also facilitates the design and construction of the valve by reducing thermal dimensional tolerances considerations. It is preferred that the cylinder openings 35, 36 be located as a pair off of a third flat side of the body section 30 of the valve 20. The preferred orientations simplifies construction (simple 90° orientations between openings, two openings on one side) and facilitates the interconnection of the cylinder pipes 24 to the valve 20.

The valve slide 22 is located within the hole 31 of the body section 30 of the valve 20 for axially sliding movement in respect thereto. This sliding action selectively interconnects the various openings to provide for the valves operation. The preferred slide valve 22 includes a main actuation section 40, a centering extension 41, and a tab extension 43.

The main actuation section 40 of the valve slide 22 is the operating mechanism for the valve, selectively interconnecting the various openings 33–36 to provide for the valving action. The clearance about the diameter of the preferred main actuation section of the slide valve is substantially 1/2000". This clearance is designed such that the slide valve 22 can be easily constructed and assembled while at the same time insuring an acceptable amount of bypass leakage between the various openings without the necessity of separate physical seals between such openings. A clearance below 1/1000" is preferred to provide this sealing in the application described. Due to this construction, no physical seal need pass over an opening or be otherwise subjected to high wear. This increases the longevity of the valve. As there are two physical seals (later described) that isolate the fluid area of the valve from the outside world, any bypass leakage is retained within the valve.

The main actuation section 40 itself includes a central passage 45, two cylinder actuation grooves 46, 47 and two seal grooves 48 (FIGS. 2, 3 and 4).

The central passage 45 serves to interconnect the return opening 34 with the pressure 33, cylinder one 35, or cylinder two 36 openings (depending on the positioning of the valve slide 22). It is preferred that the central passage 45 be in constant communication with the return opening 34. This lowers the pressure within the valve 20 by constantly draining off any stray high pressure fluid. (Note that the equivalent of the central passage 45 could be provided by a straight through single diameter hole in the valve slide 22 in combination with a slot 45A cut into the section 30 of the valve 20 on either side of the intersection 90 for the return opening 34. However, as this would entail an additional manufacturing step on the inside of the body section 30, it is not preferred.) In the normal non-actuated condition of the preferred valve 20 (FIG. 2), the return opening 34 is directly interconnected to the pressure opening 33 through a portion 50 leading straight through the valve slide 22 off of the central passage 45. In this non-actuated condition of the valve 20, the fluid from the pressure opening 33 is therefore passed straight through to the return opening 34 completely bypassing the cylinder one 35 and cylinder two openings 36. Two drilled holes 51, 52 extend upwards in the actuation section 40 off of the central passage 45. As can be seen from FIG. 3 upon shifting of the actuation section 40 inwards into the body section 30 of the valve, the central passage 45 is interconnected to the cylinder one opening 35 via the portion 51. This connects the cylinder one opening 35 to the return opening 34. The same action would at least partially close the interconnection between the pressure opening 33 and the hole portion 50 of the central passage 45 which is adjacent thereto. This disconnects the bypass between pressure 33 and return 34. As also can be seen in FIG. 3 upon shifting of the main actuation section 40 of the slide valve 22 outwards of the body section 30 of the valve, the central passage 45 is interconnected to the cylinder two opening 36 via the hole portion 52. This connects the cylinder two opening 36 to the return opening 34. This would at least partially close the interconnection between the pressure opening 33 and the central passage 45. Again this would disconnect the bypass between pressure 33 and return 34. Due to the unique trident shape of the central passage 45, the return opening 34 can thus be selectively interconnected to either the pressure 33, cylinder one 35, or cylinder two 36 openings via the axial movement of the main actuation section 40 of the valve slide 22.

There are two actuation grooves 46, 47 axially displaced from the central passage 45 in the main actuation section 40 of the valve slide 22. The straight shoulder, circular grooves 46, 47 shown are preferred due to their ease of manufacture and operational longevity. Other shapes, such as tapered shoulders or non-circular grooves, could also be utilized if desired to provide differing actuation characteristics. The preferred actuation grooves 46, 47 are displaced from the holes 51, 52 by a distance slightly greater than the diameter of the effective opening of the cylinder one 35 and cylinder two 36 openings respectively. This insures a null condition in which the cylinder one opening 35 and the cylinder two opening 36 are not interconnected to either pressure 33 (via grooves 46, 47) or return 34 (via holes 51, 52). A distance greater than the difference in diameter between the actuation member 40 and the hole 31 is further preferred. Any additional distance comprises speed of initial actuation against sealing—i.e. the greater the additional distance, the slower the initial actuation but the greater the sealing (and the null condition) and visa versa. In the preferred embodiment disclosed, the distance is 0.003". Note that both the cylinder one actuation groove 46 and the cylinder two actuation groove 47 have an extension section (55, 56 respectively), which are asymmetrically located neighboring the portion 50 of the central passage 45 adjacent to the pressure opening 33. These extension sections 55, 56 act to equalize the spacing of the actuation grooves 46, 47 from the pressure opening 33—i.e. insure that upon movement of the valve slide 22, the cylinder openings 35, 36 valve to the pressure 33 and return 34 openings at substantially the same time. This is preferred. The distance between the end of these extension sections 55, 56 and the portion 50 is therefore preferably equal to or slightly greater than the distances between the cylinder openings 35, 36 and the respective return connection holes 51, 52. This insures that the cylinder openings 35, 36 are interconnected to the pressure opening 33 at the same time as or shortly subsequent to the return opening 34. (If other operations are desired, distances can be altered if desired. An example of this would be sequential action when a cylinder opening is connected to a corresponding groove before pressure is connected to the extension section off of the groove.) The extension sections 55, 56 allow for a selective interconnection between the cylinder one 46 and cylinder two 47 actuation grooves respectively and the pressure opening 33. (Note that the equivalent of the two extensions 55, 56 could be provided by cutting two arms 55A, 56A in the body section 30 of the valve 20. In that this would necessitate an additional manufacturing operation on the inside of the body section, this change is not preferred.)

The two grooves 48 on either side of the actuation groove 46, 47 contain "O" rings. These "O" rings contact the inner diameter of the hole 31 in the body section 30 of the valve so as to insure that there will be no external leakage of the fluid to the outside of the valve. The other seals in the valve 20 between the various grooves, passages, and extensions within the valve body and about the main actuation section 40 are provided by the limited clearance between the outer diameter of the main actuation section 40 and the inner diameter of the hole 31. These clearances, in the range below 1/2000", provide sufficient sealing for the pressures involved in the preferred embodiment (hydraulic motor oil at substantially 1,200 PSI normal operating pressure and 180° F. operating temperature). This is especially so considering the presence of the "O" ring seals between the fluid area of the valve and the outside world and the constant low pressure return opening in the center of the valve (including the central passage). Any stray fluid bypass is contained within the valve. With other temperatures and pressures other ranges of clearance as seals may be appropriate. In general: A) the lower the viscosity of the oil; B) the higher operating pressure; and, C) the higher operating temperature, the smaller and/or wider the clearance must be to provide a seal.

Upon shifting of the main actuation section 40 inwards of the body section 30 of the valve, the extension section 56 will interconnect the cylinder two actuation groove 47 with the pressure opening 33. Since the cylinder two actuation groove 47 will interconnect with the cylinder two opening 36 substantially simultaneously (as seen in FIG. 3), this inward motion will selectively interconnect the pressure 33 opening with the cylinder two 36 opening. At the same time this pressure/cylinder two valving is taking place, the same inward shifting of the main actuation section 40 will interconnect the central passage 45 to the cylinder one opening 35 via the hole 51. Since this central passage 45 is in constant communication with the return opening, this inward action selectively connects the cylinder one opening 35 with the return opening 34 to complete the other half of the valving of this preferred embodiment.

Figure 2A:
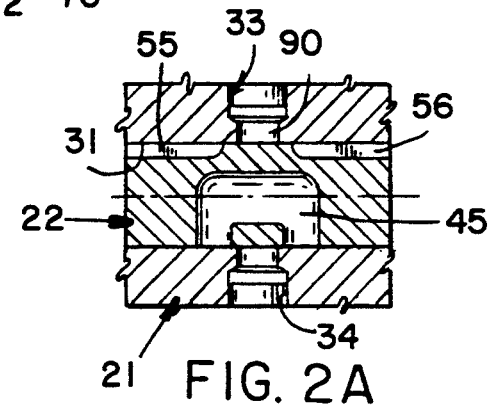

An outward motion of the main actuation section 40 will selectively interconnect the pressure opening 33 with the cylinder one opening 35 in a similar manner via the extension section 55 and the cylinder one actuation groove 46. Again at the same time this pressure/cylinder one valving is taking place the same inward shifting of the main actuation section 40 will interconnect the cylinder two opening 36 with the return opening 34 (via the hole 52 and the central passage 45). Thus an inward motion of the main actuation section 40 will selectively interconnect the pressure opening 33 with the cylinder two opening 36 while also interconnecting the cylinder one opening 35 with the return opening 34 while an outward motion of the main actuation section 40 of the valve slide 22 will interconnect the pressure opening 33 with the cylinder one opening 35 and the cylinder two opening 36 with the return opening 34. The inward and outward motion of the main actuation section 40 will thus selectively valve the four openings. Note that by omitting the portion 50 leading to the pressure opening 33, a closed center operation can be provided for the valve 20 (FIG. 2A). This change can be accompanied/-replaced by a similar connection to the return 34 opening by drilling two holes for the central passage 45 instead of milling a wide slot opening (again FIG. 2).

The centering extension 41 of the valve slide 22 insures that the main actuation section 40 is biased in a predetermined position. In the embodiment shown this predetermined position is a neutral condition in which the pressure opening 33 is connected directly to the return opening 34 with the cylinder one 35 and cylinder two 36 openings not terminated to either pressure 33 or return 34. Other predetermined conditions could also be provided. The centering section 41 disclosed accomplishes the biasing action by having a biasing spring 80. In an inward movement of the valve slide 22, the spring 80 is compressed against the reduced diameter section 83 of the hat shaped end cap 84 (itself located in the centering opening 32 by a "C" ring 85). This biases the valve slide 22 outwards. On an outward movement, the end cap 84 is moved with the valve slide 22 and the biasing spring 80 is compressed against the body section 30 of the valve 20 by the end cap 84. A screw 79 interconnects the end cap 84 to the valve slide 22 for this movement. This biases the valve slide 22 inwards. In either movement the release of the valve slide 22 returns the valve 20 to its neutral condition. This allows the main actuation section 40 to be moved inwards and outwards while providing for a return spring pressure against motion in either direction. If desired the centering mechanism could be relocated in the valve, including displacing it off of the end of the valve so as to allow for a unitary diameter hole 31 throughout the length of the valve.

The use of a single spring 80 allows substantially the same compressive force for the biasing action inward and outward. This allows for a more controlled operator movement by equalizing the operative forces in both directions. Note that a continually engaged condition can be provided to the valve 20 by incorporating a spring loaded ball into the valve body 30 and a hole in the valve slide 22 such that movement of the valve slide 22 engages the ball with the hole. (Release would occur when the operator overrode the interconnection in a further manual operation.) Other operation conditions can also be accommodated by altering the grooves, openings, the springs position and/or by using differing mechanisms or interconnections (for example two different springs, float, normal condition on or off, closed center operation, et al).

The tab extension 43 extends off the other end of the preferred valve slide 22 from the centering extension 41. This tab extension 43 interconnects the valve 20 with the external actuation member for the device. In the particular embodiment shown, the tab section 43 is machined into the valve slide 22 and the actuation member is the lever 23 (later described). In the particular embodiment disclosed, the lever 23 and tab extension 43 further serve to locate the valve slide 22 in a certain angular position in respect to the body section 30 such that the various openings and extensions are aligned in their proper positions. (For example the extension sections 55, 56 are located adjacent to the pressure opening 33 instead of 180° opposite next to the return section 34.) The lever 23 and the tab extension 43 thus together play an important part in the valve 20 by insuring that the valve slide 22 is located in its correct operating position. The lever 23 and tab extension 43 accomplish this by being asymmetric. Due to the asymmetry of the mounting of the lever 23 in respect to the tab extension 43, the actuation section 40 must be correctly oriented in the valve 20. Therefore if the valve 20 has been assembled, the parts are in their correct operating positions. In the particular embodiment disclosed, the tab extension 43 is asymmetric by having a half moon cross section (asymmetry of the lever later described).

Due to the shape of the central passage 45 and the extensions 55, 56 from the cylinder actuation grooves 46, 47, the body section 30 for the valve 20 does not need any significant machining or other mechanical operations thereon before utilization in the valve: The six major holes and openings can be provided with a drill or other rotary cutting tool in single operations with simple 90° orientation changes. This significantly simplifies the construction of the body section 30 of the valve. The valve slide 22 in turn can be constructed on a rotary turning machine with the possible exception of the central passage 45 (including holes 51, 52), the extension grooves 55, 56 and the tab extension 43 (which are easily manufactured on a milling machine or even a drill press). The valve 20 is thus simple to construct on low tolerance machines. In addition most of the parts of the valve can be (and are in the preferred embodiment) made out of simple round or rectangular stock.

The actuator lever 23 is the main operator control for the valve. The actuator lever 23 in addition aid in orienting the main actuation section 40 of the valve slide 22 into its correct operating position. In the embodiment shown the actuator lever 23 is a solid metal member having a body 60 with a handle 61, a connecting flange 62, and an actuation flange 63.

The handle 61 on the actuator lever 23 is designed for manipulation by the operator. Its shape and length is thus made suitable for the particular application involved. The valve 20 shown is utilized in a lawn and garden tractor. For this reason the handle is substantially 3" long by 1.5" wide for mounting in the dash next to the steering wheel of such tractor.

Figure 5:
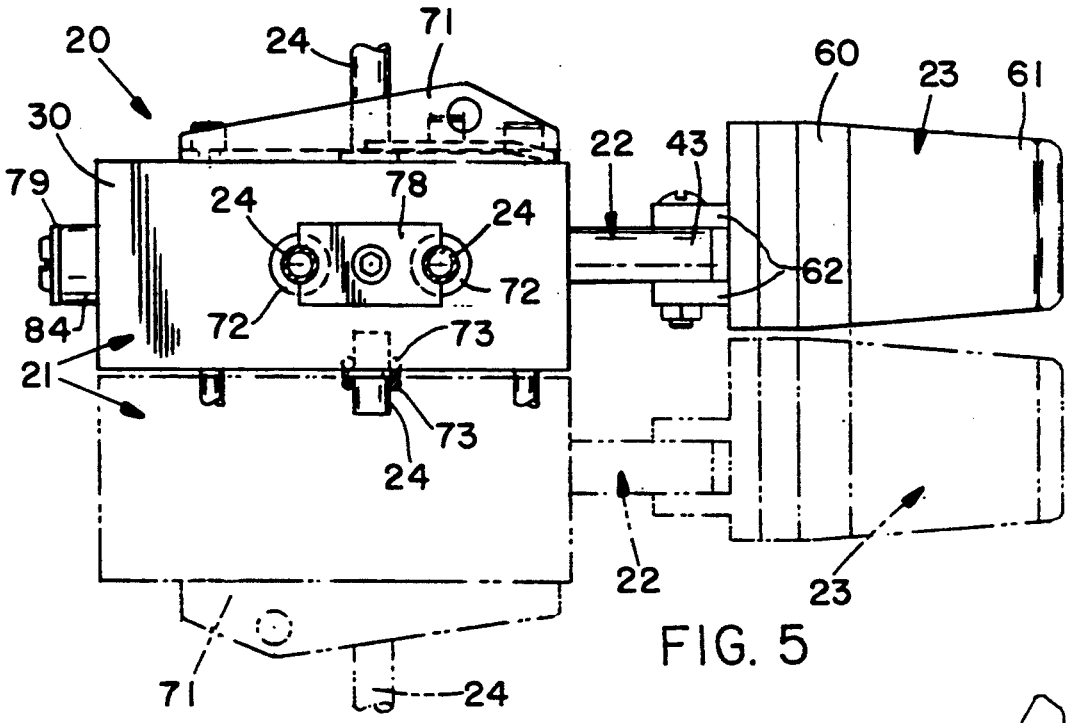
Figure 6:
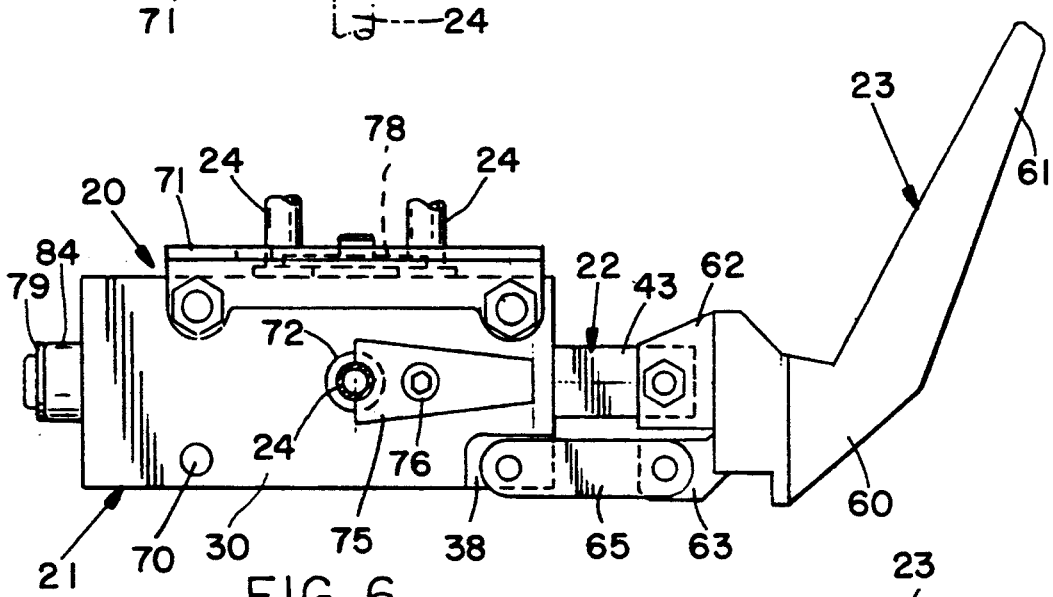
Figure 6A:
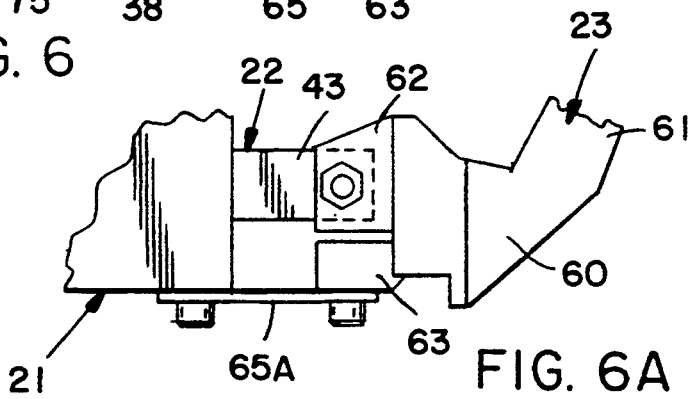
Figure 7:
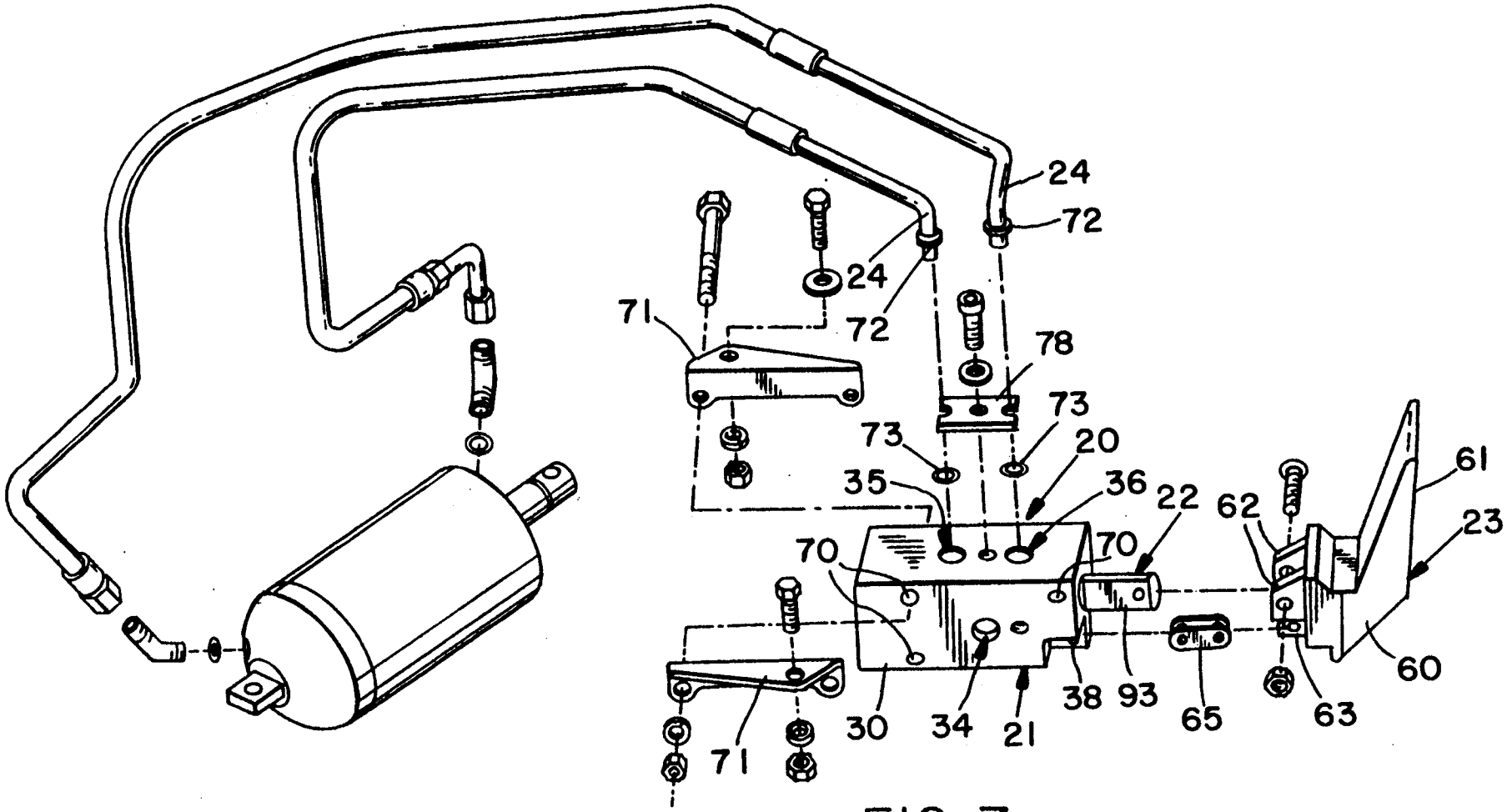

The connection flange 62 of the lever 23 mechanically interconnects the actuator lever 23 with the tab extension 43 of the slide valve 22 via a pin type connection. The connection flange 62 itself is located asymmetrically so as to insure that the tab extension 43 (and thus the valve slide 22) is in its correct angular position upon the mounting of the actuator lever 23 onto the valve 20. This cooperation between the level 23 and tab 43 can be best seen in FIG. 5 of the application. The actuation flange 63 of the lever 23 in turn cooperates with two links 65 and a tab 38 on the body section 30 of the valve to provide for a reaction member for the actuator lever 23. These links allow some floating alignment between the lever 23 and valve 20. These links 65 also orient the actuator lever 23 in respect to the body section 30 of the valve. Note that the tab 38 on the body section 30 of the valve is machined. This produces a strong and familiar mounting for the links 65, albeit at some cost. If desired the connection flange 62 could be interconnected to a flat side of the valve by making the body side of the link 65 a hinge having an additional flat part and using a bolt to interconnect the additional flat part of the link to the flat side of the valve. A flexible flat non-compressible hinge 65A could also be utilized (FIG. 6A). This omission of the tab 38 would further lower the cost for the valve. Again asymmetry is preferred so as to locate the operative parts in their correct position.

Since it is contemplated that the preferred valves 20 will be utilized in multiple banks, the actuator lever 23 is itself in addition located asymmetrically in respect to the body section 30 of the valve. This asymmetric location of the lever 23 insures that adjoining valves 20 will be located in their correct operating positions in respect to each other—i.e. in the embodiment disclosed the pressure inlet of one valve will be aligned with the return outlet of the preceding valve. This is another place where the asymmetry of the actuator lever 23 insures the correct assembly of the valve.

Upon an operator's manipulation of the handle 61 of the actuator lever 23, the valve slide 22 is moved inwardly and outwardly as previously described to operate such valve.

The body section 30 is mounted to the device with which it will be utilized in the preferred embodiment disclosed via three mounting holes 70 drilled through the body section of the valve. Normally an external mounting flange 71 is bolted to the body section 30 in order to allow a simplified semi-floating mounting.

The pipes 24 interconnect the valve 20 with the outside world, in the particular instance involved—pressure, return, cylinder one, and cylinder two. The pipes 24 as shown in the preferred embodiment are substantially ¼" in outer diameter with 1/16" thick side walls. A small 1/16" by 1/16" protrusion 72 is connected to the ends of these pipes 24 substantially ¼" from the end thereof. To assemble the pipes 24 to the valve 20, an "O" ring 73 is fitted over the end of the pipe next to this protrusion 72. The ends of the pipes 24 are in turn placed in the intermediate section 91 of the openings with the seal 73 in engagement with the seal groove 92 of such opening. A saddle shaped bracket 75 member is then located on the outside of the protrusion 72 with a screw 76 passing through a hole 77 therein. Upon tightening of the screw 76, into a threaded hole in the body of the valve, the bracket 75 tightens down against the protrusion 72 so as to interconnect the pipe 24 with the body section 30 of the valve. The compression of the seal 73 between the protrusion 72 and the body section 30 of the valve prevents any external leaks. (The seal groove section 92 acts to retain the "O" ring 73 in its correct positioning as well as providing an expanded sealing surface for the pipe 24.) The "O" ring 73 allows for some flexing of the pipe 24 in respect to the valve body as well as providing for some overall dimensional tolerances.

Where two pipes 24 are adjoining, for example the cylinder one and cylinder two pipes, an "H" shape bracket 78 is utilized so as to hold both pipes 24 with a single bracket. If two valves are located next to each other, an in line pipe 24 is utilized having two seals 73 on opposite sides of a single protrusion (see FIG. 5). Upon the bolting of the two body sections of the valves together, each valve 20 then acts as a bracket in respect to the other valve so as to prevent the leakage on either side of the in line pipe 24. Washers preferably would be utilized between adjoining valves to provide the appropriate spacing. Alternately the protrusion 72 can be counter sunk into the valve body by an appropriate amount so as to allow a flush junction.

Although the invention has been described in its preferred embodiment with a certain degree of particularity, it is to be understood that numerous changes can be made without deviating from the invention as hereinafter claimed.

What is claimed:

1. In a valve having a body section with pressure, return, and two bi-directional fluid openings and a valve slide having actuation grooves, the valve slide selectively interconnecting the openings upon the axial actuation thereof, the valve used with a reservoir, the improvement of the fluid openings in the body section of the valve being straight through holes for cooperation with the actuation grooves to valve the fluid, there being a single return opening in the body section of the valve emptying to the reservoir, means for the selective actuation of the valve slide to interconnect one of the bi-directional openings to one of the pressure and return openings and to interconnect the other of the bi-directional openings to the other of the pressure and return openings, and one of the actuation grooves including a central passage being aligned with and extending on either side of the return opening directly opening thereto in one given operative position of the valve.

2. The valve of claim 1 characterized in that said central passage opens to said pressure opening in said one operative position of the valve.

3. In a valve having a body section with fluid openings and a valve slide having actuation grooves, the improvement of the fluid openings in the body section of the valve being straight through holes for cooperation with the actuation grooves to valve the fluid, one of the actuation grooves including a central passage extending on either side of one of the openings in one operative position of the valve, another opening, said another opening opening into said central passage in said one operative position of the valve, two additional actuation grooves, said two additional actuation grooves extending on either side of said central passage, two extensions, said two extensions extending towards said another opening respectively, and said two extensions being displaced from said another opening in said one operative position of the valve.

4. In a valve having a body section with pressure, return, and two bi-directional fluid openings and a valve slide having actuation grooves, the actuation grooves on the valve slide having a correct angular orientation in respect to the fluid openings and the valve having an operating lever associated with the valve slide to move such valve axially, the improvement of the fluid openings in the body section of the valve being straight through holes for cooperation with the actuation grooves to valve the fluid, and an asymmetric means on one of the operating lever and the valve slide such that the interconnection of the operating lever to the valve slide angularly orients the actuation grooves on the valve slide in the correct angular orientation in respect to the fluid openings.

5. The valve of claim 4 characterized in that said asymmetric means is on both the operating lever and the valve slide.

6. In a valve having a body section with fluid openings and a valve slide having actuation grooves, the improvement of the fluid openings in the body section being straight through holes, a central passage, said central passage being located in the valve slide, said central passage extending on either side of one of the openings in one operative position of the valve, said central passage communicating with another opening in said one operative position of the valve, two actuation grooves, said two actuation grooves being located in the valve slide on either side of said central passage, a third and fourth opening being located in the body section opening between said two actuation grooves and said central passage in said one operative position of the valve, two extensions, and said two extensions being located in the valve slide extending off of said two actuation grooves towards said another opening and said two extensions being displaced from said another opening in said one operative position of the valve.

7. The valve of claim 6 characterized in that the body section of the valve is a rectangular shaped cube.

8. The valve of claim 6 characterized in that two extensions and said another opening are located on the opposite side of the valve from said one of the openings.

9. The valve of claim 6 wherein the actuation grooves on the valve slide have a preferred angular orientation in respect to the fluid openings and the valve has an operating lever associated with the valve slide and characterized in the addition of an asymmetric means on one of the operating lever and the valve slide such that interconnection of the operating lever to the valve slide angularly orients the actuation grooves on the valve slide in the preferred angular orientation in respect to the fluid openings.

10. The valve of claim 9 characterized in that said asymmetric means is on both the operating lever and the valve slide.

11. The valve of claim 6 wherein the valve is used with a pipe having an end having a diameter and characterized in that an opening has a diameter substantially equal to the end of the pipe with the end of the pipe releasably inserted into the opening, a bracket, and said bracket holding the end of the pipe in the opening.

12. The valve of claim 6 characterized by the addition of a protrusion, said protrusion being located on the pipe spaced from the end thereof, said bracket cooperating with said protrusion to hold the pipe in the opening, a seal, and said seal being about the pipe between said protrusion and the end of the pipe.

13. In a valve having a body section with fluid openings and a valve slide having actuation grooves, the improvement of the body section of the valve being a rectangular shaped cube, the fluid openings in the body section being straight through holes, a central passage, said central passage being located in the valve slide, said central passage extending on either side of one of the openings in one operative position of the valve, said central passage communicating with another opening in said one operative position of the valve, two actuation grooves, said two actuation grooves being located in the valve slide on either side of said central passage, a third and fourth opening being located in the body section opening between said two actuation grooves and said central passage in said one operative position of the valve, said third and fourth openings having diameters respectively, said two actuation grooves being spaced from said central passage by at least said diameters of said third and fourth openings respectively, two extensions, said two extensions being located in the valve slide extending off of said two actuation grooves towards said another opening, said two extensions being spaced from said another opening in said one operative position of the valve by at least said diameters of said third and fourth openings respectively, said two extensions and said another opening are located on the opposite side of the valve from said one of the openings, said actuation grooves on the valve slide having a preferred angular orientation in respect to the fluid openings, an operating lever, said operating lever being associated with the valve slide, an asymmetric means, said asymmetric means being on one of the operating lever and the valve slide such that interconnection of the operating lever to the valve slide angularly orients the actuation grooves on the valve slide in the preferred angular orientation in respect to the fluid openings.

14. In a valve having a body section with fluid openings and an axially moving valve slide having actuation grooves, the fluid openings including two bi-directional openings and a pressure opening and a return opening, the improvement of the fluid openings in the body section of the valve being straight through holes for cooperation with the actuation grooves to valve the fluid, and means for the actuation grooves to selectively interconnect both of the bi-directional-openings and the pressure opening to the return opening.

15. The valve of claim 14 characterized in that the actuation grooves constantly communicate with one of the pressure opening and the return opening and the actuation grooves selectively communicate with the other of the pressure opening and the return opening.

16. The valve of claim 15 wherein the valve slide has an axis and characterized in that the actuation grooves include pressure grooves to interconnect the pressure opening selectively to the two bi-directional openings and return grooves to interconnect the return opening selectively to the two bi-directional openings, and said pressure grooves overlapping said return grooves along the axis of the valve slide.

17. The valve of claim 14 wherein the valve slide has an axial length and characterized in that one of the actuation grooves includes a central passage extending on either side of one of the pressure and return opening in one operative position of the valve, and said central passage being displaced from both of the two bi-directional openings along the axial length of the valve in said one operative position of the valve.

18. The valve of claim 17 characterized by the addition of two additional actuation grooves on either side of said central passage and two extensions, said two extensions extending towards said another opening respectively, and said two extensions being displaced from said another opening in said one operative position of the valve.

19. In a valve having a body section with a pressure opening and a return opening and two bi-directional openings, and an axially moving valve slide having actuation grooves, the actuation grooves connecting the pressure opening to the return opening in a neutral position with the valve slide selectively interconnecting the pressure and the return openings with the two bi-directional openings upon the actuation thereof off of the neutral position, the improvement of the openings in the body section of the valve being straight through holes for cooperation with the actuation grooves to valve the fluid, and means for the actuation grooves to substantially simultaneously connect the pressure opening to one of the two bi-directional openings while interconnecting the other of the two bi-directional openings to the return opening.

20. The valve of claim 19 wherein the valve slide has an axis and characterized in that the actuation grooves include pressure grooves to interconnect the pressure opening selectively to the two bi-directional openings and return grooves to interconnect the return opening selectively to the two bi-directional openings, and said pressure grooves overlapping said return grooves along the axis of the valve slide.

21. The valve of claim 19 characterized in that the actuation grooves constantly communicate with one of the pressure opening and return opening and the actuation grooves selectively communicate with the other of the pressure opening and return opening.

22. The valve of claim 19 wherein the valve slide has an axial length and characterized in that one of the actuation grooves includes a central passage extending on either side of one of the pressure and return opening in one operative position of the valve, and said central passage being displaced from both of the two bi-directional openings along the axial length of the valve in the one operative position of the valve.

23. In a valve having a body section with a pressure opening and a return opening and two bi-directional openings, and an axially moving valve slide having actuation grooves, the improvement of the openings in the body section of the valve being straight through holes for cooperation with the actuation grooves to valve fluid, a central passage, said central passage being in said valve slide, said central passage communicating constantly with the return opening, and said central passage being selectively connectable to the pressure opening and to one of the two bi-directional openings so as to interconnect same with the return opening.

24. The valve of claim 23 characterized by the addition of two actuation grooves, said two actuation grooves being on either side of said central passage respectively, and means for said two actuation grooves to interconnect one of the two bi-directional openings to the pressure opening selectively as the device is operated.

25. The valve of claim 24 characterized by the addition of two extension sections, said two extension sections extending off of said two actuation grooves respectively towards said central passage, and said two extension sections selectively interconnecting said actuation grooves to said pressure openings.

* * * * *